US009972908B2

(12) United States Patent
Sanchez

(10) Patent No.: US 9,972,908 B2
(45) Date of Patent: May 15, 2018

(54) CAPACITIVELY COUPLED LOOP INVERTED F RECONFIGURABLE ANTENNA

(71) Applicant: FutureWei Technologies, Inc., Plano, TX (US)

(72) Inventor: Jorge Fabrega Sanchez, San Diego, CA (US)

(73) Assignee: FUTUREWEI TECHNOLOGIES, INC., Plano, TX (US)

( * ) Notice: Subject to any disclaimer, the term of this patent is extended or adjusted under 35 U.S.C. 154(b) by 294 days.

(21) Appl. No.: 13/939,631

(22) Filed: Jul. 11, 2013

(65) Prior Publication Data

US 2015/0015445 A1 Jan. 15, 2015

(51) Int. Cl.

| | |
|---|---|
| ***H01Q 5/00*** | (2015.01) |
| ***H01Q 7/00*** | (2006.01) |
| ***H01Q 5/364*** | (2015.01) |
| ***H01Q 5/328*** | (2015.01) |
| ***H01Q 9/04*** | (2006.01) |
| ***H01Q 5/321*** | (2015.01) |

(52) U.S. Cl.

CPC ..... *H01Q 5/364* (2015.01); *H01Q 5/321* (2015.01); *H01Q 5/328* (2015.01); *H01Q 7/00* (2013.01); *H01Q 9/0421* (2013.01)

(58) Field of Classification Search

CPC ..... H01Q 5/328; H01Q 5/364

See application file for complete search history.

(56) References Cited

U.S. PATENT DOCUMENTS

| | | | | |
|---|---|---|---|---|
| 7,239,290 | B2 * | 7/2007 | Poilasne | H01Q 1/241 343/866 |
| 2013/0154897 | A1 * | 6/2013 | Sorensen et al. | 343/861 |
| 2013/0237162 | A1 * | 9/2013 | Yoon | H01Q 5/328 455/77 |

OTHER PUBLICATIONS

"Application Note: PIN Diode Basics". Skyworks. Aug. 15, 2008 http://www.skyworksinc.com/uploads/documents/200823A.pdf.*

Wyatt, Kenneth. "Resistors Aren't Resistors." EDN, Oct. 29, 2013. Web. Dec. 7, 2015. http://www.edn.com/design/components-and-packaging/4423492/Resistors-aren-t-resistors.*

Boyle, K. et al., "A Five-Band Reconfigurable PIFA for Mobile Phones," IEEE Transactions on Antennas and Propagation, Nov. 2007, pp. 3300-3309, vol. 55, No. 11.

(Continued)

*Primary Examiner* — Jessica Han
*Assistant Examiner* — Amal Patel
(74) *Attorney, Agent, or Firm* — Futurewei Technologies, Inc.

(57) ABSTRACT

System and method embodiments are provided for capacitive coupled loop inverted F reconfigurable multiband antenna. The embodiments enable tuning and adjustment of the low frequency response of the antenna without appreciably effecting the high frequency response of the antenna. In an embodiment, a reconfigurable multiband antenna includes a first antenna section comprising a first end and a second end, wherein the second end is coupled to an antenna feed, a second antenna section comprising a third end and a fourth end, wherein the third end is coupled to ground, and a switch coupling the second end to the third end, wherein the first end and the fourth end are capacitively coupled.

18 Claims, 7 Drawing Sheets

(56) References Cited

OTHER PUBLICATIONS

Li, Y. et al., "A Compact Hepta-Band Loop-Inverted F Reconfigurable Antenna for Mobile Phone," IEEE Transactions on Antennas and Propagation, Jan. 2012, pp. 389-392, vol. 60, No. 1.
Sung, Y., "Compact Quad-Band Reconfigurable Antenna for Mobile Phone Applications," Electronic Letters, Aug. 2, 2012, 2 pages, vol. 48, No. 16.
Wang, D. et al., "A Quad-Band Loop PIFA Antenna for Wireless Applications," Pecen Research in Motion, Ltd. www.rim.com, Sep. 28, 2008-Oct. 2, 2008, 2 pages.

* cited by examiner

CAPACITIVELY COUPLED LOOP INVERTED F RECONFIGURABLE ANTENNA

TECHNICAL FIELD

The present invention relates to a antennas, and, in particular embodiments, to loop and inverted F reconfigurable antennas.

BACKGROUND

New frequency bands are being added worldwide to support the needs of new 4G standards, such as LTE, to provide higher data rates and quality service for wireless device users. These wireless devices are packed with antennas needed to support multiple radios with multiband operation. Particularly challenging is the design of antennas that can support multiple low frequency bands, such as B12, B5, B8, B20, etc., in today's smaller form factor wireless devices.

SUMMARY OF THE INVENTION

In accordance with an embodiment, a reconfigurable multiband antenna includes a first antenna section comprising a first end and a second end, wherein the second end is coupled to an antenna feed, a second antenna section comprising a third end and a fourth end, wherein the third end is coupled to ground, and a switch coupling the second end to the third end, wherein the first end and the fourth end are capacitively coupled.

In accordance with another embodiment, a wireless device includes a processor and a tunable multiband antenna coupled to the processor, wherein the tunable multiband antenna comprises a first antenna section comprising a first end and a second end, wherein the second end is coupled to an antenna feed, a second antenna section comprising a third end and a fourth end, wherein the third end is coupled to ground, and a switch coupling the second end to the third end, wherein the first end and the fourth end are capacitively coupled.

In accordance with another embodiment, a reconfigurable multimode antenna includes first and second antenna sections capacitively coupled at first ends; and a switch connecting second ends of the first and second antenna section, wherein antenna is configured to operate in a loop mode when the switch is open, and wherein the antenna is configured to operate in a planar inverted-F antenna mode when the switch is closed.

BRIEF DESCRIPTION OF THE DRAWINGS

For a more complete understanding of the present invention, and the advantages thereof, reference is now made to the following descriptions taken in conjunction with the accompanying drawing, in which:

FIG. 4 is a schematic diagram of an embodiment configurable multimode antenna with the switch on;

DETAILED DESCRIPTION OF ILLUSTRATIVE EMBODIMENTS

Figure 1:
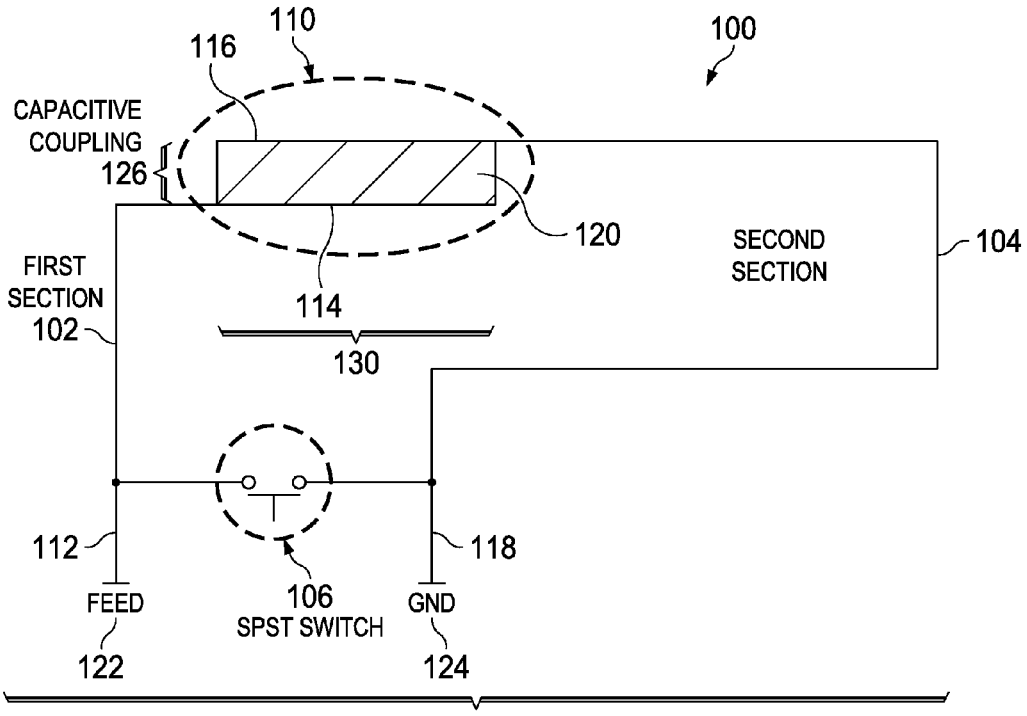
FIG. 1 is a schematic diagram of an embodiment reconfigurable multimode antenna.

The making and using of the presently preferred embodiments are discussed in detail below. It should be appreciated, however, that the present invention provides many applicable inventive concepts that can be embodied in a wide variety of specific contexts. The specific embodiments discussed are merely illustrative of specific ways to make and use the invention, and do not limit the scope of the invention.

Disclosed herein is a reconfigurable antenna configuration that includes at least two antenna sections and a switch. The first antenna section includes a first end and a second end and the second antenna section includes a third end (i.e., the first end of the second antenna section) and a fourth end (i.e., the second end of the second antenna section). In an embodiment, the second end is connected to the antenna feed and the first end is capacitively coupled to the fourth end (i.e., a second end of the second section). The third end (i.e., a first end of the second antenna section) is connected to ground. A switch connects the second end (of the first section) to the third end (e.g., the first end of the second section). The switch enables the antenna to operate in two different low frequency band modes depending on the position of the switch (open or closed). The high band is not effected by tuning of the low frequency band. Thus, operation mode switching enables tuning at the low frequency band while keeping the high frequency bands of operation constant.

In an embodiment, the antenna includes a grounded parasitic element to increase the bandwidth of the high end frequency band.

In an embodiment, each antenna section includes matching circuits to tune the antenna and match it at the desired low frequency bands of operation. The matching circuits may include capacitors, inductors, and/or traces with specific dimensions. In an embodiment, one of the matching circuits may be placed between the switch and the first end of the first antenna section and the other matching circuit may be placed between the switch and the second end of the second antenna section.

In an embodiment, the disclosed reconfigurable antenna may cover multiple frequency bands with a small antenna volume. The design of the reconfigurable antenna is easy to tune and/or adjust. The reconfigurable antenna can be tuned by either adjusting the antenna trace length on PCB or using discrete components, such as, for example, capacitors. The antenna high frequency band is very broad (e.g., approximately 1.7-3 Gigahertz (GHz)) and presents high efficiency for both low frequency mode and high frequency mode of operation. This may be beneficial for inter-band (e.g., low frequency band+high frequency band combinations) carrier aggregation applications. No additional tunable matching requirements are necessary to match the antenna in both states (e.g., low frequency band mode and high frequency band mode).

In an embodiment, the reconfigurable antenna operates in a planar inverted-F antenna (PIFA) mode when the switch is on (closed) and operates in a loop mode when the switch is off (open). In an embodiment, the switch is a single pole, single throw (SPST) switch.

FIG. 1 is a schematic diagram of an embodiment reconfigurable multimode antenna 100. The antenna 100 includes a first antenna section 102, a second antenna section 104, and a switch 106. In an embodiment, the switch is a SPST switch. The first antenna section 102 includes a first end 112 and a second end 114. The second antenna section 104 includes a first end 116 and a second end 118. In an embodiment, the first antenna section 102 and the second antenna section 104 are formed from a metal, such as, for example, copper.

The first end 112 of the first antenna section 102 is conned to an antenna feed 122. The second end 114 of the first antenna section 102 is capacitively coupled 110 to a first end 116 of the second antenna section 104. If the first antenna section 102 and the second antenna section 104 are directly connected rather than capacitively connected, the antenna 100 will not be in PIFA mode when the switch is "on". The second end 114 of the first antenna section 102 and the first end 116 of the second antenna section 104 are separated by a distance d 126. In an embodiment, the distance d 126 is about 0.5 millimeters (mm) to about 1 mm. The second end 114 of the first antenna section 102 overlaps the first end 116 of the second antenna section 104 by a length l 130. In an embodiment, the length l 130 is about 8 mm to about 10 mm. In an embodiment, the separation 120 between the second end 114 of the first antenna section 102 and the first end 116 of the second antenna section 104 is a dielectric. In embodiments, the dielectric in the separation 120 is a plastic. In other embodiments, the dielectric in the separation 120 may be a vacuum, a glass, or a ceramic.

In an embodiment, the total PCB length of the antenna 100 is around 120 mm by 64 mm. In an embodiment, the antenna volume of the antenna 100 is around 6 mm by 64 mm by 6 mm.

The second end 118 of the second section is connected to ground 124. The first end 112 of the first antenna section 102 is connected to the second end 118 of the section antenna section 104 by the switch 106. The antenna 100 functions in a planar inverted-F antenna (PIFA) mode when the switch 106 is closed (i.e., on). The antenna 100 functions in a loop mode when the switch 106 is open (i.e., off). Operating the switch 106 allows tuning of the low frequency band of the antenna 100 without effecting the operation of the high frequency bands (i.e., keeping the high frequency bands of operation substantially constant).

Figure 2:
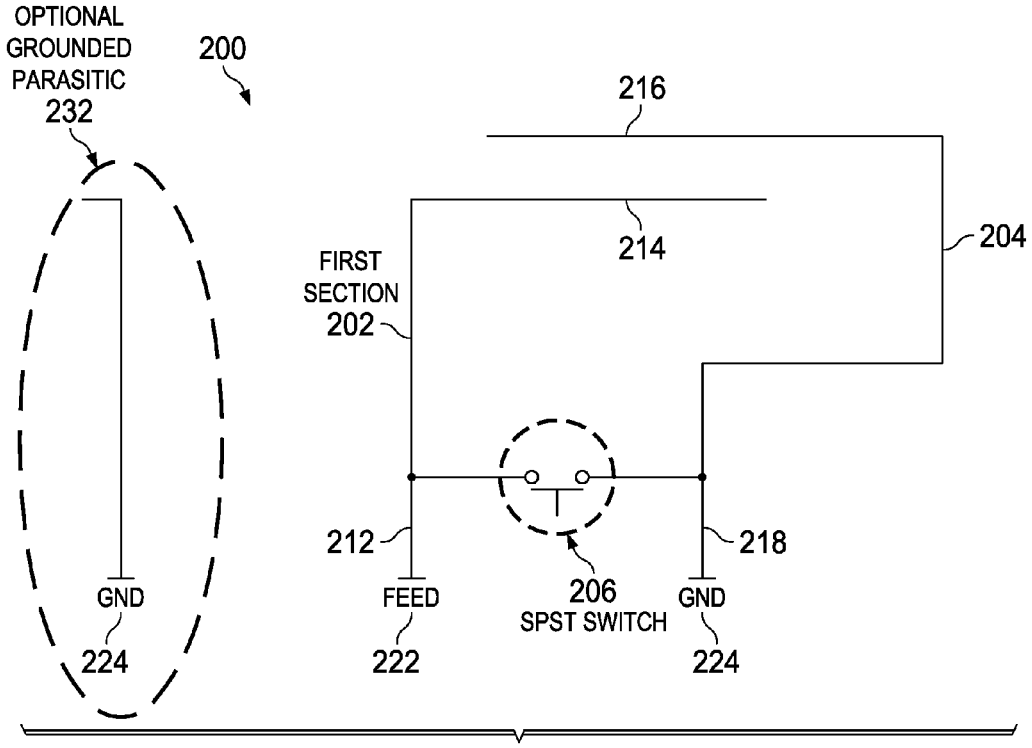
FIG. 2 is a schematic diagram of another embodiment reconfigurable antenna.

FIG. 2 is a schematic diagram of another embodiment reconfigurable multimode antenna 200. Antenna 200 is similar to antenna 100 in FIG. 1 except for the inclusion of a grounded parasitic element 232. In an embodiment, the elements of antenna 200 are arranged in a similar manner and operate in a similar manner to those of antenna 100 in FIG. 1. Antenna 200 includes a first antenna section 202, a second antenna section 204, a switch 206, and a grounded parasitic element 232. In an embodiment, the switch is a SPST switch. The first antenna section 202 includes a first end 212 and a second end 214. The second antenna section 204 includes a first end 216 and a second end 218. The first end 212 of the first antenna section 202 is conned to an antenna feed 222. The second end 214 of the first antenna section 202 is capacitively coupled to a first end 216 of the second antenna section 204. The second end 218 of the second section is connected to ground 224. The first end 212 of the first antenna section 202 is connected to the second end 218 of the section antenna section 204 by the switch 206. The antenna 200 functions in a planar inverted-F antenna (PIFA) mode when the switch 206 is closed (i.e., on). The antenna 200 functions in a loop mode when the switch 206 is open (i.e., off).

In addition to elements similar to those in FIG. 1, antenna 200 includes a grounded parasitic element 232 that is connected to ground 224 and electromagnetically coupled to the first antenna section 202. The grounded parasitic element 232 increases the bandwidth of the high end frequency band performance of the antenna 200.

Figure 3:
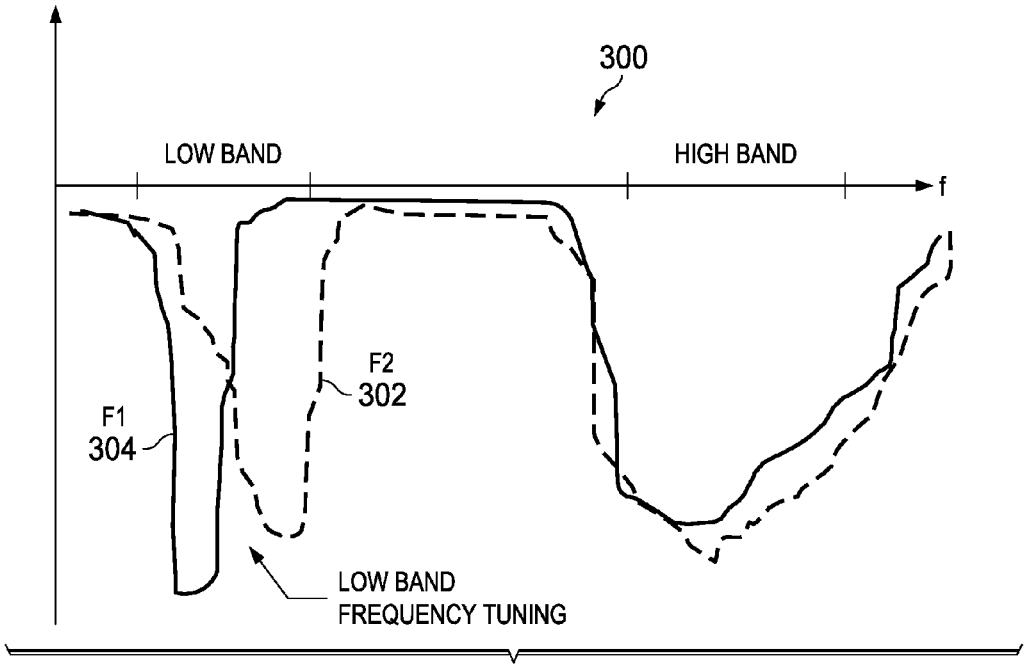
FIG. 3 illustrates a graph of operating response return logs of a configurable antenna as a function of frequency for the switch on and for the switch off.

FIG. 3 illustrates a graph 300 of operating response return logs of the antenna 200 as a function of frequency for the switch on and for the switch off. Graph 300 includes a plot 302 of the operation of antenna 200 with the switch on and a plot 304 of the operation of antenna 200 with the switch off. As can be seen in FIG. 3, the central frequency F1 of the low band response of the antenna 200 with the switch off can be adjusted to a central frequency F2 with the switch on without effecting the response of the antenna 200 at high frequencies.

Figure 4:
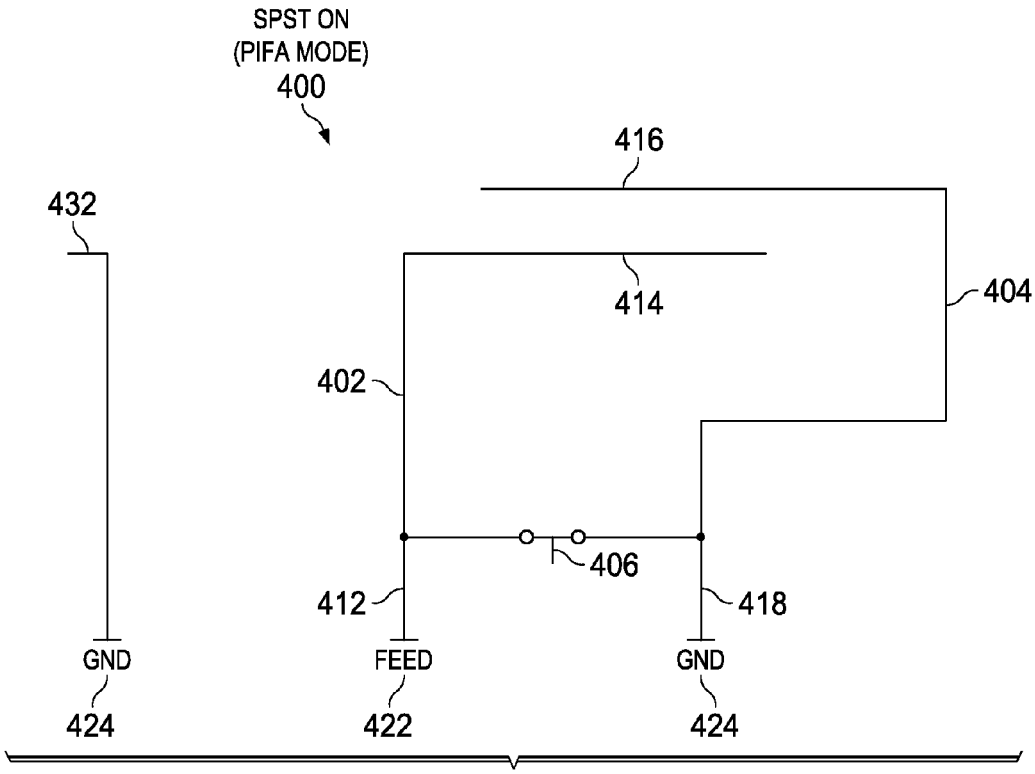

FIG. 4 is a schematic diagram of an embodiment configurable multimode antenna 400 with the switch on. Antenna 400 is similar to antenna 200 in FIG. 2. The elements of antenna 400 are arranged in a similar manner and operate in a similar manner to similar elements in antenna 200 in FIG. 2. Antenna 400 includes a first antenna section 402, a second antenna section 404, a switch 406, and a grounded parasitic element 432. In an embodiment, the switch is a SPST switch. The first antenna section 402 includes a first end 412 and a second end 414. The second antenna section 404 includes a first end 416 and a second end 418. The first end 412 of the first antenna section 402 is conned to an antenna feed 422. The second end 414 of the first antenna section 402 is capacitively coupled to a first end 416 of the second antenna section 404. The second end 418 of the second section is connected to ground 424. The first end 412 of the first antenna section 402 is connected to the second end 418 of the section antenna section 404 by the switch 406. As shown in FIG. 4, the switch 406 is in the on (i.e., closed) position. In this position, the antenna 400 operates in a PIFA mode.

Figure 5:
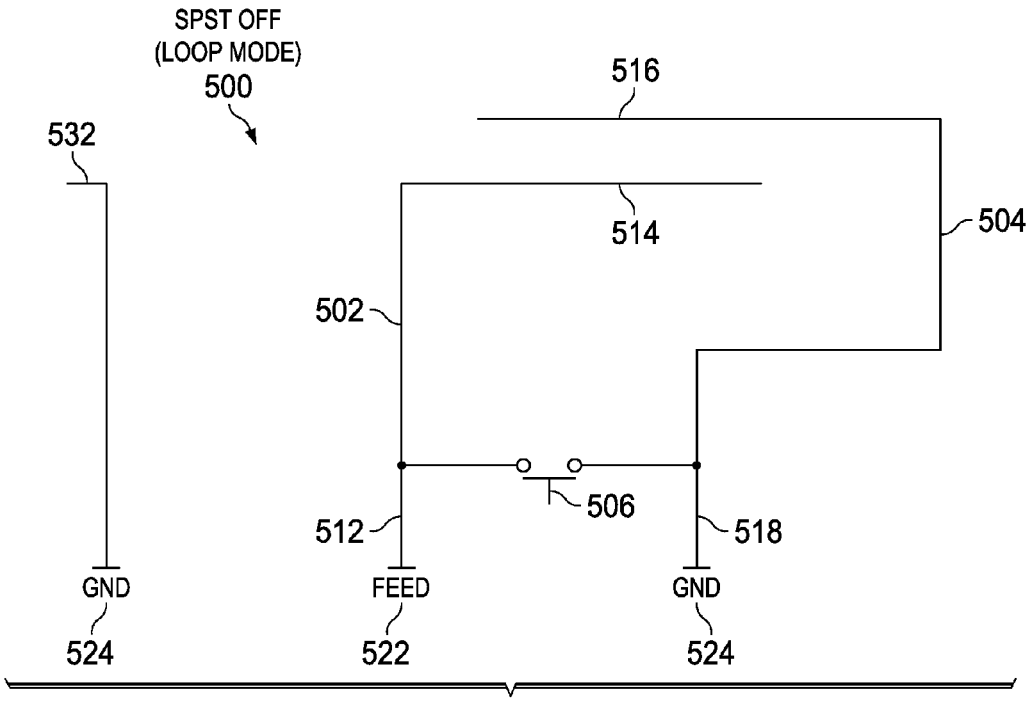
FIG. 5 is a schematic diagram of an embodiment configurable multimode antenna with the switch off.

FIG. 5 is a schematic diagram of an embodiment configurable multimode antenna 500 with the switch off. Antenna 500 is similar to antenna 200 in FIG. 2. The elements of antenna 500 are arranged in a similar manner and operate in a similar manner to similar elements in antenna 200 in FIG. 2. Antenna 500 includes a first antenna section 502, a second antenna section 504, a switch 506, and a grounded parasitic element 532. In an embodiment, the switch is a SPST switch. The first antenna section 502 includes a first end 512 and a second end 514. The second antenna section 504 includes a first end 516 and a second end 518. The first end 512 of the first antenna section 502 is conned to an antenna feed 522. The second end 514 of the first antenna section 502 is capacitively coupled to a first end 516 of the second antenna section 504. The second end 518 of the second section is connected to ground 524. The first end 512 of the first antenna section 502 is connected to the second end 518 of the section antenna section 504 by the switch 506. As shown in FIG. 5, the switch 506 is in the off (i.e., open) position. In this position, the antenna 500 operates in a loop mode (i.e., loop antenna mode) or like a loop antenna.

Figure 6:
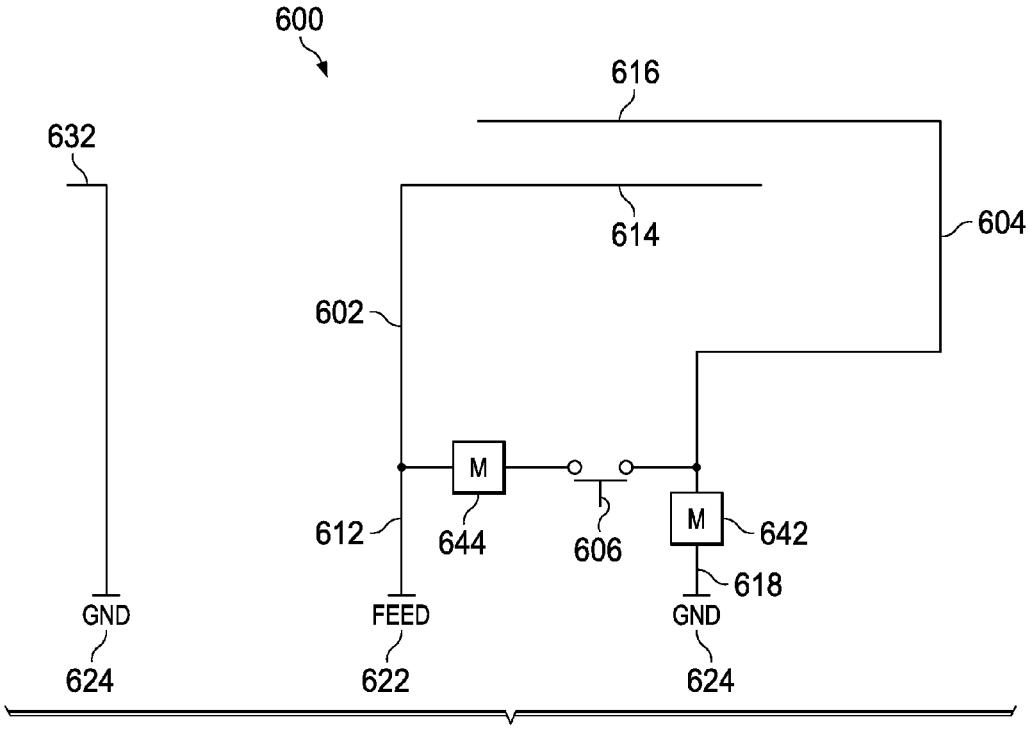
FIG. 6 is a schematic diagram of an embodiment configurable multimode antenna.

FIG. 6 is a schematic diagram of an embodiment configurable multimode antenna 600. Antenna 600 is similar to antenna 200 in FIG. 2. The elements of antenna 600 are arranged in a similar manner and operate in a similar manner to similar elements in antenna 200 in FIG. 2. Antenna 600 includes a first antenna section 602, a second antenna section 604, a switch 606, and a grounded parasitic element 632. In an embodiment, the switch is a SPST switch. The first antenna section 602 includes a first end 612 and a second end 614. The second antenna section 604 includes a first end 616 and a second end 618. The first end 612 of the first antenna section 602 is conned to an antenna feed 622. The second end 614 of the first antenna section 602 is capacitively coupled to a first end 616 of the second antenna section 604. The second end 618 of the second section is connected to ground 624. The first end 612 of the first antenna section 602 is connected to the second end 618 of the section antenna section 604 by the switch 606.

In addition to the elements that are similar to antenna 200, antenna 600 includes matching circuits 642, 644 (labeled "M"). Matching circuit 644 is connected between the first end 612 of the first antenna section 602 and the switch 606. Matching circuit 642 is connected between the second end 618 of the second antenna section 604 and ground 624. The circuits in matching circuit 642 and matching circuit 644 should be substantially identical. The matching circuits 642, 644 may be either distributed or discrete components. The matching circuits 642, 644 are used to tune the antenna 600 at the desired low frequency bands of operation. In an embodiment, the matching circuits 642, 644 are composed of capacitors and/or inductors. In an embodiment, the matching circuits 642 and 644 are just two traces with certain dimensions (length, width, thickness) used to tune the antenna's low frequency bands of operation.

Figure 7:
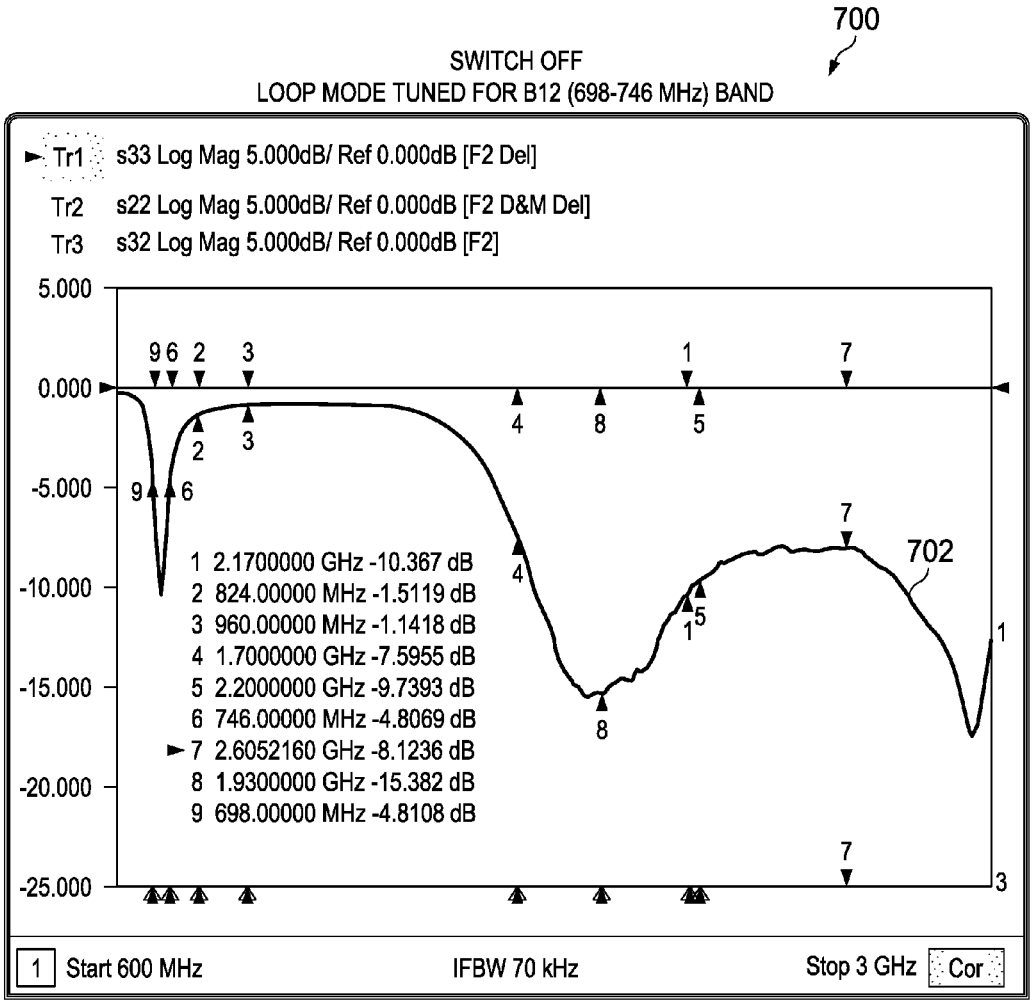
FIG. 7 is a graph of the operating response return log of the B12 band of an embodiment reconfigurable multimode antenna.

FIG. 7 is a graph 700 of the operating response return log of the B12 (698-746 Megahertz (MHz)) band of an embodiment reconfigurable multimode antenna. Graph 700 includes a plot 702 of the loop mode (e.g., switch off) tuned for B12 (698-746 MHz) band of a reconfigurable antenna, such as, for example, antenna 200 depicted in FIG. 2.

Figure 8:
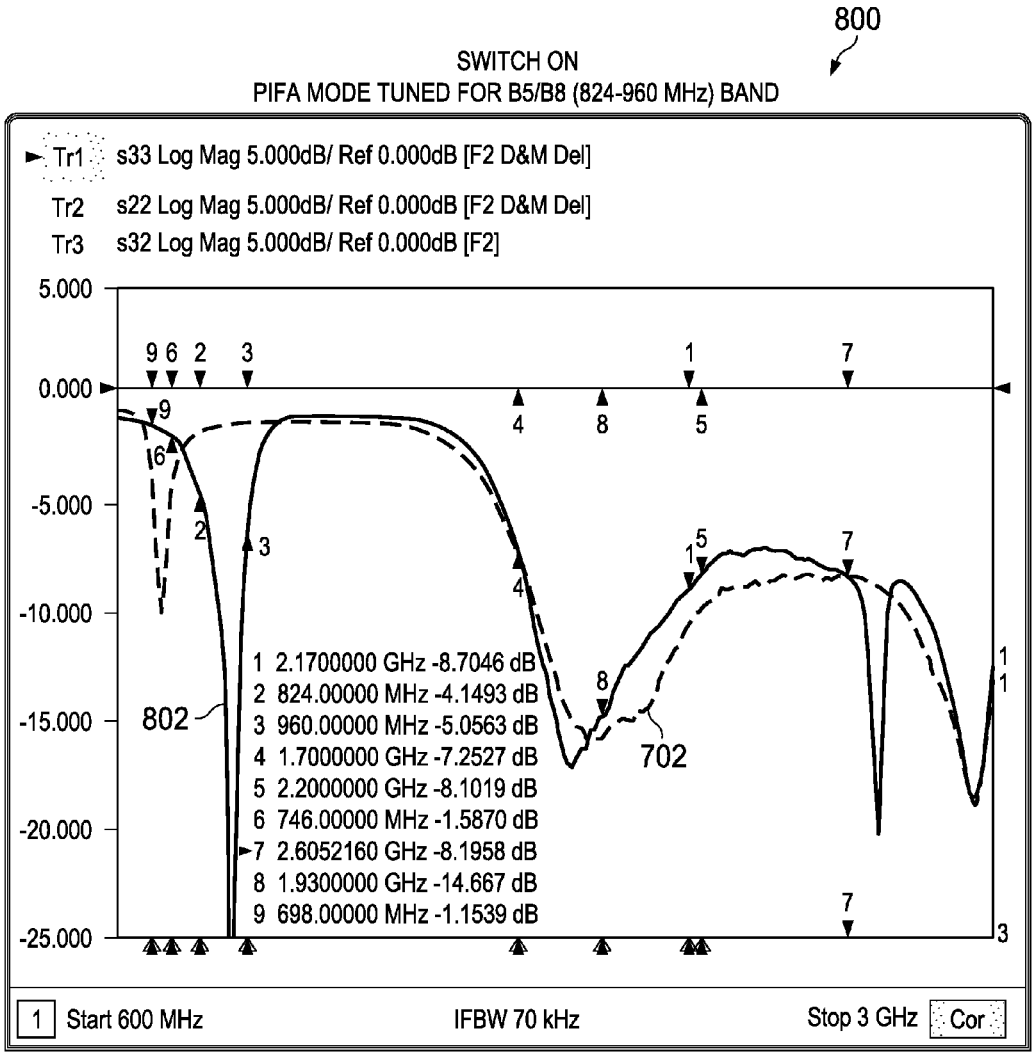
FIG. 8 is a graph of the operating response return logs of the B12 band and B5/B8 band of an embodiment reconfigurable multimode antenna.

FIG. 8 is a graph 800 of the operating response return log of the B12 band and B5/B8 band of an embodiment reconfigurable multimode antenna. The graph 800 includes a plot 702 of the loop mode (e.g., switch off) tuned for B12 band as shown in FIG. 7 and also a plot 802 of the PIFA mode (e.g., switch on) tuned B5/B8 (824-960 MHz) band of a reconfigurable multimode antenna, such as, for example, antenna 200 depicted in FIG. 2. As shown in FIG. 8, the high frequency response of both the loop mode and the PIFA mode for the antenna are very similar with almost no change between the two modes. However, the low frequency response is tunable between the B12 band and the B5/B8 band through use of the switch in the reconfigurable multimode antenna.

Figure 9:
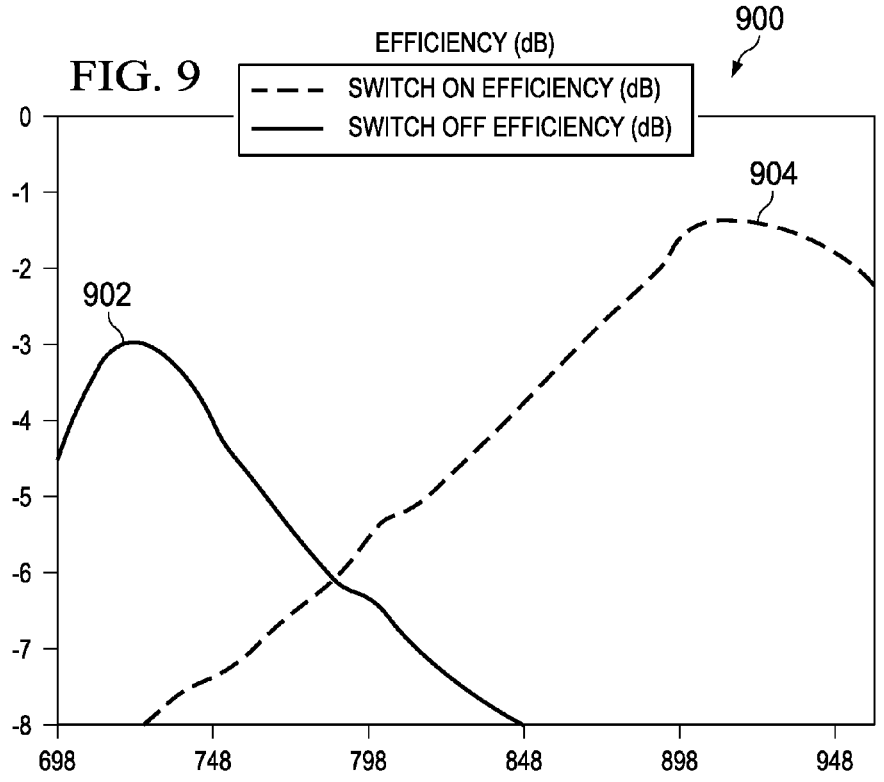
FIG. 9 is a graph of the efficiencies of the low frequency band mode operation of a reconfigurable multimode antenna for both switch on and switch off.

FIG. 9 is a graph 900 of the efficiencies of the low frequency band mode of operation of a reconfigurable multimode antenna for both switch on and switch off. Plot 902 shows the efficiency of a reconfigurable multimode antenna, such as antenna 200, with the switch on, and plot 904 shows the efficiency of a reconfigurable multimode antenna with the switch off, each as a function of frequency, for the low frequency band mode of the antenna. As shown, the most efficient frequency for the low frequency band mode changes depending on the switch position.

Figure 10:
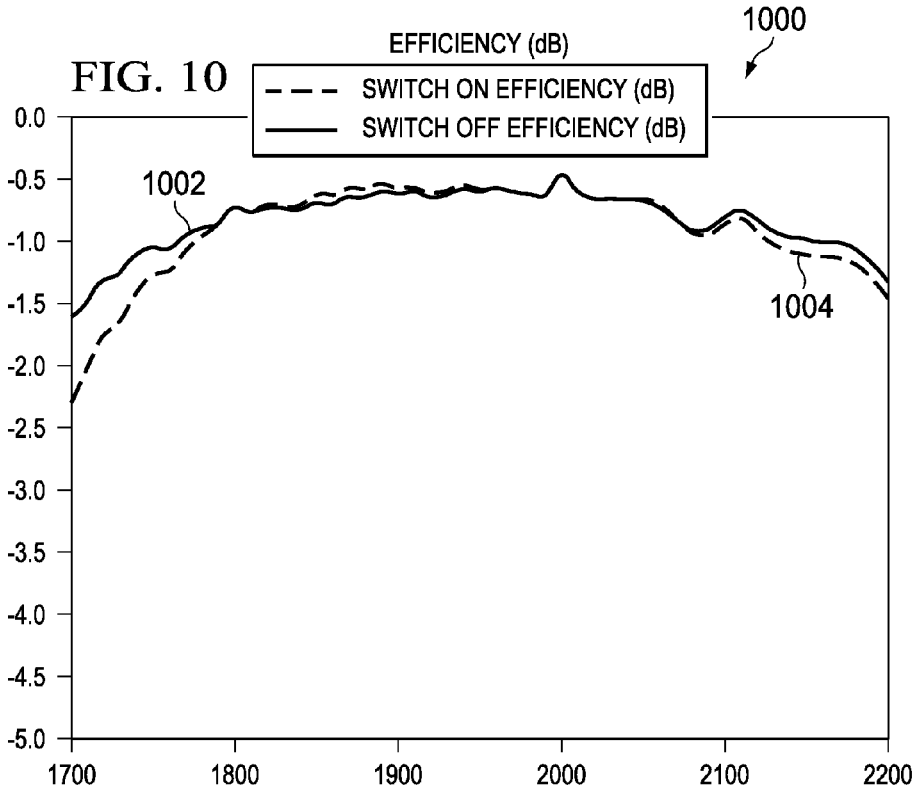
FIG. 10 is a graph of the efficiencies of the high frequency band mode operation of a reconfigurable multimode antenna for both switch on and switch off.

FIG. 10 is a graph 1000 of the efficiencies of the high frequency band mode of operation of a reconfigurable multimode antenna for both switch on and switch off. Plot 1002 shows the efficiency of a reconfigurable multimode antenna, such as antenna 200, with the switch on, and plot 1004 shows the efficiency of a reconfigurable multimode antenna with the switch off, each as a function of frequency, for the high frequency band of the antenna. As shown, the efficiency of the high frequency band of the antenna does not appreciably change with switch position. In other words, the performance of the high frequency band of the antenna stays substantially the same regardless of how the low frequency band of the antenna is tuned with the switch.

Figure 11:
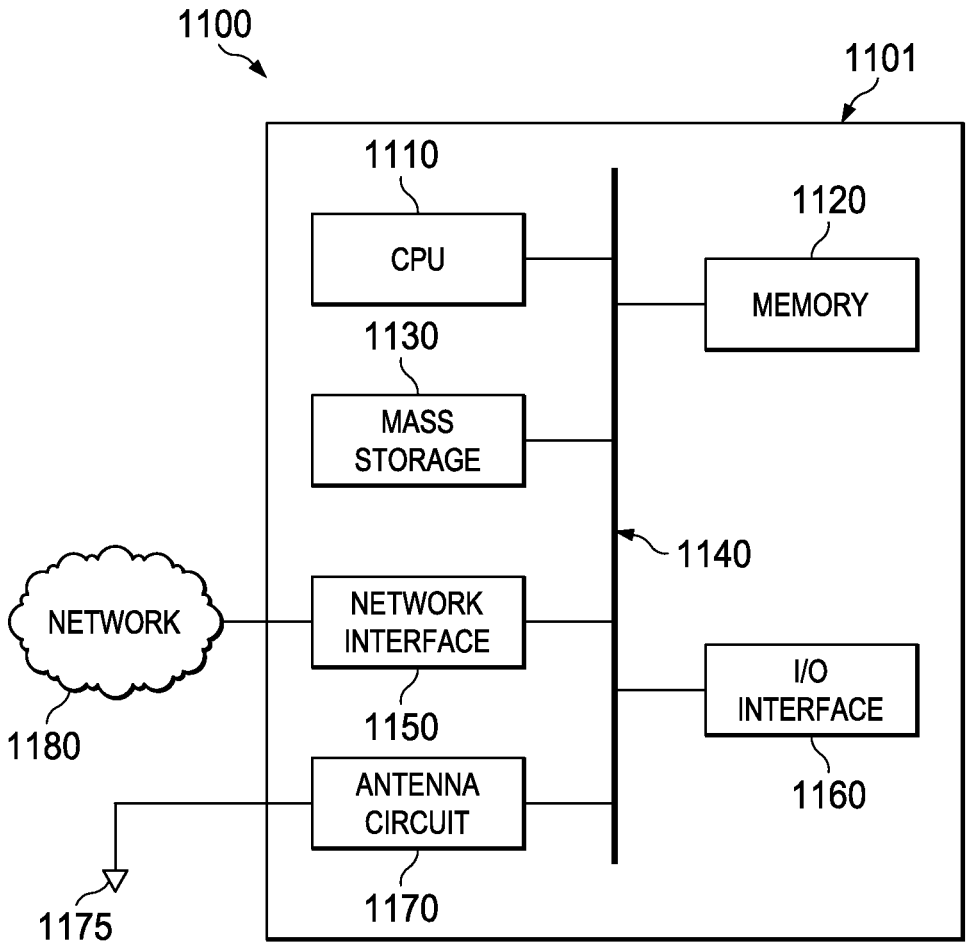
FIG. 11 is a processing system that can be used to implement various embodiments.

FIG. 11 is a block diagram of a processing system 1100 that may be used for implementing the devices and methods disclosed herein. Specific devices may utilize all of the components shown, or only a subset of the components and levels of integration may vary from device to device. Furthermore, a device may contain multiple instances of a component, such as multiple processing units, processors, memories, transmitters, receivers, etc. The processing system 1100 may comprise a processing unit 1101 equipped with one or more input/output devices, such as a speaker, microphone, mouse, touchscreen, keypad, keyboard, printer, display, and the like. The processing unit 1101 may include a central processing unit (CPU) 1110, memory 1120, a mass storage device 1130, a network interface 1150, an I/O interface 1160, and an antenna circuit 1170 connected to a bus 1140. The processing unit 1101 also includes an antenna element 1175 connected to the antenna circuit.

The bus 1140 may be one or more of any type of several bus architectures including a memory bus or memory controller, a peripheral bus, video bus, or the like. The CPU 1110 may comprise any type of electronic data processor. The memory 1120 may comprise any type of system memory such as static random access memory (SRAM), dynamic random access memory (DRAM), synchronous DRAM (SDRAM), read-only memory (ROM), a combination thereof, or the like. In an embodiment, the memory 1120 may include ROM for use at boot-up, and DRAM for program and data storage for use while executing programs.

The mass storage device 1130 may comprise any type of storage device configured to store data, programs, and other information and to make the data, programs, and other information accessible via the bus 1140. The mass storage device 1130 may comprise, for example, one or more of a solid state drive, hard disk drive, a magnetic disk drive, an optical disk drive, or the like.

The I/O interface 1160 may provide interfaces to couple external input and output devices to the processing unit 1101. The I/O interface 1160 may include a video adapter. Examples of input and output devices may include a display coupled to the video adapter and a mouse/keyboard/printer coupled to the I/O interface. Other devices may be coupled to the processing unit 1101 and additional or fewer interface cards may be utilized. For example, a serial interface such as Universal Serial Bus (USB) (not shown) may be used to provide an interface for a printer.

The combination of antenna circuit 1170 and antenna element 1175 may be implemented to include any of antennas 100, 200, 400, 500, or 600. The antenna circuit 1170 and antenna element 1175 may allow the processing unit 1101 to communicate with remote units via a network. In an embodiment, the antenna circuit 1170 and antenna element 1175 provide access to a wireless wide area network (WAN) and/or to a cellular network, such as Long Term Evolution (LTE), Code Division Multiple Access (CDMA), Wideband CDMA (WCDMA), and Global System for Mobile Communications (GSM) networks. In some embodiments, the antenna circuit 1170 and antenna element 1175 may also provide Bluetooth and/or WiFi connection to other devices.

The processing unit 1101 may also include one or more network interfaces 1150, which may comprise wired links, such as an Ethernet cable or the like, and/or wireless links to access nodes or different networks. The network interface 1101 allows the processing unit 1101 to communicate with remote units via the networks 1180. For example, the network interface 1150 may provide wireless communication via one or more transmitters/transmit antennas and one or more receivers/receive antennas. In an embodiment, the processing unit 1101 is coupled to a local-area network or a wide-area network for data processing and communications with remote devices, such as other processing units, the Internet, remote storage facilities, or the like.

Although the description has been described in detail, it should be understood that various changes, substitutions and alterations can be made without departing from the spirit and scope of this disclosure as defined by the appended claims. Moreover, the scope of the disclosure is not intended to be limited to the particular embodiments described herein, as one of ordinary skill in the art will readily appreciate from this disclosure that processes, machines, manufacture, compositions of matter, means, methods, or steps, presently existing or later to be developed, may perform substantially the same function or achieve substantially the same result as the corresponding embodiments described herein. Accordingly, the appended claims are intended to include within their scope such processes, machines, manufacture, compositions of matter, means, methods, or steps.

What is claimed is:

1. A reconfigurable multiband antenna comprising:

a first antenna section (102) comprising a first end (112) and a second end (114) wherein the first end (112) and the second end (114) form a right angle, wherein the first end (112) is coupled to an antenna feed (122);

a second antenna section (104) comprising a first end (116) and a second end (118), wherein the second end (118) is coupled to ground (124), and wherein the second end (114) of the first antenna section (102) overlaps the first end (116) of the second antenna section (104);

wherein the second antenna section (104) forms three right angles; and a switch coupling the first end (112) of the first antenna section (102) to the second end (118) of the second antenna section (104), wherein each antenna section includes one or more matching circuits to tune the antenna section to a desired frequency band of operation;

wherein the second end (114) of the first antenna section (102) and the first end (116) of the second antenna section (104) are capacitively coupled; and wherein the antenna is configured to operate in different frequency band modes with the change of the position of the switch.

2. The reconfigurable multiband antenna of claim 1, wherein the switch comprises a single pole, single throw switch.

3. The reconfigurable multiband antenna of claim 1, wherein the reconfigurable multiband antenna operates in a planar inverted-F antenna mode when the switch is closed.

4. The reconfigurable multiband antenna of claim 1, wherein the reconfigurable multiband antenna operates in a loop antenna mode when the switch is open.

5. The reconfigurable multiband antenna of claim 1, further comprising a grounded parasitic element capacitively coupled to the first antenna section (102).

6. The reconfigurable multiband antenna of claim 1, wherein the switch provides low frequency tuning of the reconfigurable multiband antenna, and a high frequency response of the reconfigurable multiband antenna is not affected by a position of the switch.

7. The reconfigurable multiband antenna of claim 1, wherein the second end (114) of the first antenna section (102) and the first end (116) of the second antenna section (104) are separated by a dielectric.

8. The reconfigurable multiband antenna of claim 7, wherein the dielectric comprises one of a vacuum, a plastic, a glass, and a ceramic.

9. The reconfigurable multiband antenna of claim 1, wherein the second end (114) of the first antenna section (102) and the first end (116) of the second antenna section (104) are substantially parallel.

10. A wireless device comprising:

a processor; and a tunable multiband antenna coupled to the processor, wherein the tunable multiband antenna comprises:

a first antenna section (102) comprising a first end (112) and a second end (114) wherein the first end (112) and the second end (114) form a right angle, wherein the first end (112) is coupled to an antenna feed (122), a second antenna section (104) comprising a first end (116) and a second end (118), wherein the second end (118) is coupled to ground (124), and wherein the second end (114) of the first antenna section (102) overlaps the first end (116) of the second antenna section (104) wherein the second antenna section (104) forms three right angles, and a switch coupling the first end (112) of the first antenna section (102) to the second end (118) of the second antenna section (104), wherein each antenna section includes one or more matching circuits to tune the antenna section to a desired frequency band of operation;

wherein the second end (114) of the first antenna section (102) and the first end (116) of the second antenna section (104) are capacitively coupled; and wherein the antenna is configured to operate in different frequency band modes with the change of the position of the switch.

11. The wireless device of claim 10, wherein the switch comprises a single pole, single throw switch.

12. The wireless device of claim 10, wherein the tunable multiband antenna operates in a planar inverted-F antenna mode when the switch is closed.

13. The wireless device of claim 10, wherein the tunable multiband antenna operates in a loop antenna mode when the switch is open.

14. The wireless device of claim 10, further comprising a grounded parasitic element (232) capacitively coupled to the first antenna section (102).

15. The wireless device of claim 10, wherein the switch provides low frequency tuning of the tunable multiband antenna, and a high frequency response of the tunable multiband antenna is not affected by a position of the switch.

16. The wireless device of claim 10, wherein the second end (114) of the first antenna section (102) and the first end (116) of the second antenna section (104) are separated by a dielectric.

17. The wireless device of claim 16, wherein the dielectric comprises one of a vacuum, a plastic, a glass, and a ceramic.

18. The wireless device of claim 10, wherein the second end (114) of the first antenna section (102) and the first end (116) of the second antenna section (104) are substantially parallel.

* * * * *